US008963677B2

(12) United States Patent
Xu et al.

(10) Patent No.: US 8,963,677 B2
(45) Date of Patent: Feb. 24, 2015

(54) OIL IMMERSED STEREO WOUND-CORE AMORPHOUS ALLOY TRANSFORMER

(75) Inventors: Kaixuan Xu, Kaiping (CN); Xianqing Guo, Kaiping (CN)

(73) Assignee: Haihong Electric Co., Ltd., Kaiping, Guangdong (CN)

( * ) Notice: Subject to any disclaimer, the term of this patent is extended or adjusted under 35 U.S.C. 154(b) by 0 days.

(21) Appl. No.: 13/820,737

(22) PCT Filed: Oct. 31, 2011

(86) PCT No.: PCT/CN2011/081593
§ 371 (c)(1), (2), (4) Date: Mar. 4, 2013

(87) PCT Pub. No.: WO2013/016903
PCT Pub. Date: Feb. 7, 2013

(65) Prior Publication Data

US 2013/0162381 A1 Jun. 27, 2013

(30) Foreign Application Priority Data

Aug. 2, 2011 (CN) ..... 2011 2 0277712 U

(51) Int. Cl.

| | |
|---|---|
| ***H01F 27/26*** | (2006.01) |
| ***H01F 30/12*** | (2006.01) |
| ***H01F 27/10*** | (2006.01) |
| ***H01F 27/02*** | (2006.01) |
| ***H01F 27/24*** | (2006.01) |

(Continued)

(52) U.S. Cl.
CPC ..... *H01F 27/06* (2013.01); *H01F 27/008* (2013.01); *H01F 27/26* (2013.01); *H01F 27/306* (2013.01); *H01F 30/12* (2013.01); *H01F 27/25* (2013.01)
USPC ..... 336/210; 336/5; 336/58; 336/90; 336/94; 336/213; 336/214

(58) Field of Classification Search
USPC ..... 336/5, 55–58, 61, 90, 94, 179, 182, 336/210, 212–214, 233
See application file for complete search history.

(56) References Cited

U.S. PATENT DOCUMENTS 3,302,149 A * 1/1967 Forsha ..... 336/58
4,588,971 A * 5/1986 Beisser ..... 336/5

(Continued)

FOREIGN PATENT DOCUMENTS

CN 2515777 Y 10/2002
CN 2775812 Y * 4/2006

(Continued)

*Primary Examiner* — Mangtin Lian
(74) *Attorney, Agent, or Firm* — Loginov & Associates, PLLC; William A. Loginov

(57) ABSTRACT

An oil immersed stereo wound-core amorphous alloy transformer, comprising an iron core, a high-low voltage winding, leads and a tank. The core comprises three single frames made of amorphous alloy strips by winding and are identical in structure, and the single frames have a rectangular shape; the vertical sides of every two adjacent frames fit together fixedly to form a core pillar, and the horizontal sides of the single frame form iron yokes; the cross sections of the core pillars have an approximately circular or polygonal shape; the transformer further comprises a clamp, comprising a quasi-triangular upper and lower clamp, and posts, the lower clamp is provide with three food pads; the iron yokes in the lower portion of the iron core are located on the foot pads, and the high-low voltage winding is wound on the core pillars.

5 Claims, 5 Drawing Sheets

(51) Int. Cl.

| | |
|---|---|
| ***H01F 27/06*** | (2006.01) |
| ***H01F 27/00*** | (2006.01) |
| ***H01F 27/30*** | (2006.01) |
| *H01F 27/25* | (2006.01) |

(56) References Cited

U.S. PATENT DOCUMENTS

| | | | | | |
|---|---|---|---|---|---|
| 4,745,966 | A | * | 5/1988 | Avery | 165/104.33 |
| 5,202,664 | A | * | 4/1993 | Poulsen | 336/5 |
| 2006/0001516 | A1 | * | 1/2006 | Mazur et al. | 336/5 |

FOREIGN PATENT DOCUMENTS

| | | | | |
|---|---|---|---|---|
| CN | 200979833 | Y | | 11/2007 |
| CN | 201196898 | Y | * | 2/2009 |
| CN | 201196898 | Y | | 2/2009 |
| CN | 201741537 | U | | 2/2011 |

* cited by examiner

OIL IMMERSED STEREO WOUND-CORE AMORPHOUS ALLOY TRANSFORMER

TECHNICAL FIELD

This invention is in the field of power equipment, and particularly relates to an oil immersed amorphous alloy transformer with stereo structure.

BACKGROUND

For conventional oil immersed amorphous alloy transformers, the iron cores and windings are manufactured separately, and subsequently the wound windings are sleeved onto the core pillars in assembly. During production, an iron core is processed through a series of steps, including iron yoke seam opening, winding sleeving, seam closing, winding pressing, and so on. Due to the processes outlined above, the iron core is impacted by usually external forces and subjected to performance degradation. This leads to higher no-load loss for the finally assembled iron core relative to the bare iron core.

In addition, a conventional amorphous alloy iron core is usually of a three-leg or four-frame five-leg structure, wherein the three-phase windings are arranged in one line. Its tank is of a rectangular structure, and The whole transformer is immersed in the insulation oil in a tank having a rectangular structure.

SUMMARY OF THE INVENTION

The aim of this invention is to provide an oil immersed stereo wound-core amorphous alloy transformer, which can fully use the advantages of transformers made from amorphous alloy, including, for example, saving energy, reducing production processes, increasing production efficiency, and avoiding the impacts of production on the core performance, as well as saving materials in large degree.

The invention is realized through an oil immersed stereo wound-core amorphous alloy transformer, comprising an iron core, a high-low voltage winding, leads and a tank. The transformer is characterized in that: the iron core comprises three structurally identical single rectangular frames which are made of amorphous alloy strips by winding; the cross-section of the side of each single frame is in an approximately semi-circular or semi-polygonal shape; the sides of the single frames each have a semi-circular cross section and uniform thickness, the vertical sides of every two adjacent frames fit together fixedly to form a core pillar, the horizontal sides of the singles frame form iron yokes; the cross section of each core pillar is in a quasi-circular or quasi-polygonal shape; the transformer further comprises a clamp, comprising a quasi-triangular upper clamp, a quasi-triangular lower clamp, and posts, the lower clamp is provide with three foot pads, wherein one end of each foot pad is for fixed connection, and the other end is welded to a side of the lower clamp; the iron yokes in the lower portion of the iron core are located on the foot pads, the high-low voltage winding is wound on the core pillars; and the clamp, iron core, and high-low voltage winding wound on the core pillars are arranged within the tank.

Furthermore, the oil immersed stereo wound-core amorphous alloy transformer is characterized in that: the foot pads support the lower clamp and are fixedly connected with a base plate of the tank.

Furthermore, the oil immersed stereo wound-core amorphous alloy transformer is characterized in that: oil ducts are provided between the high voltage windings and low voltage windings of the high-low voltage winding.

Furthermore, the oil immersed stereo wound-core amorphous alloy transformer is characterized in that: insulation paper boards and corrugated paper boards are provided between the high voltage windings and the lower voltage windings of the high-low voltage winding.

Furthermore, the oil immersed stereo wound-core amorphous alloy transformer is characterized in that: the cross section of the tank is quasi-triangle shaped.

Furthermore, the oil immersed stereo wound-core amorphous alloy transformer is characterized in that: the tank is provided with radiators on the side surfaces thereof.

The present invention provides an oil immersed stereo wound-core amorphous alloy transformer, adopting a stereo-triangle structure comprising three single frames made of amorphous alloy strips by winding. Compared with the existing technologies, the oil immersed stereo wound-core amorphous alloy transformer according to the present invention has the advantages of fewer processing steps, a seamless iron yoke, and less impact of external disturbances on the iron core performance. Fewer processing steps increase production efficiency. The no-load loss of the transformer is further reduced and more energy is saved.

DETAILED DESCRIPTION OF THE EMBODIMENTS

Detailed descriptions of the embodiments of the invention will be made with reference to the drawings.

Figure 1:
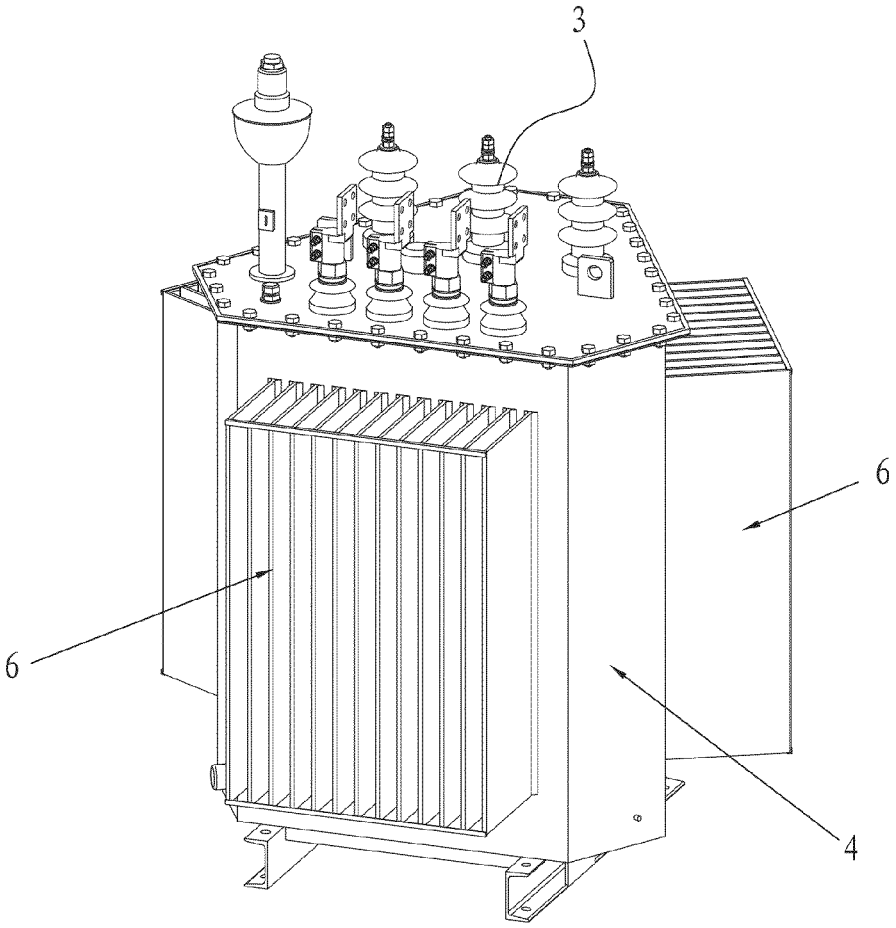
FIG. 1 is a perspective view of the present invention.
Figure 2:
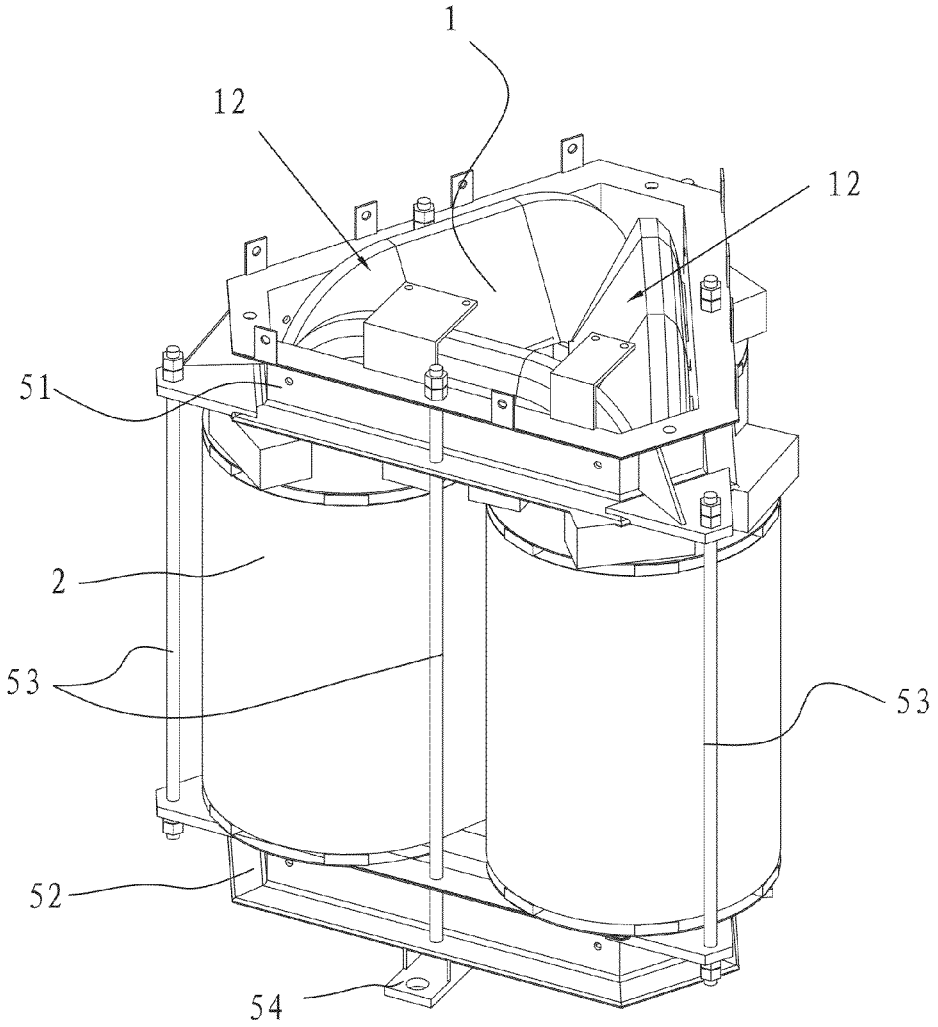
FIG. 2 is a perspective view of the present invention without the tank.
Figure 3:
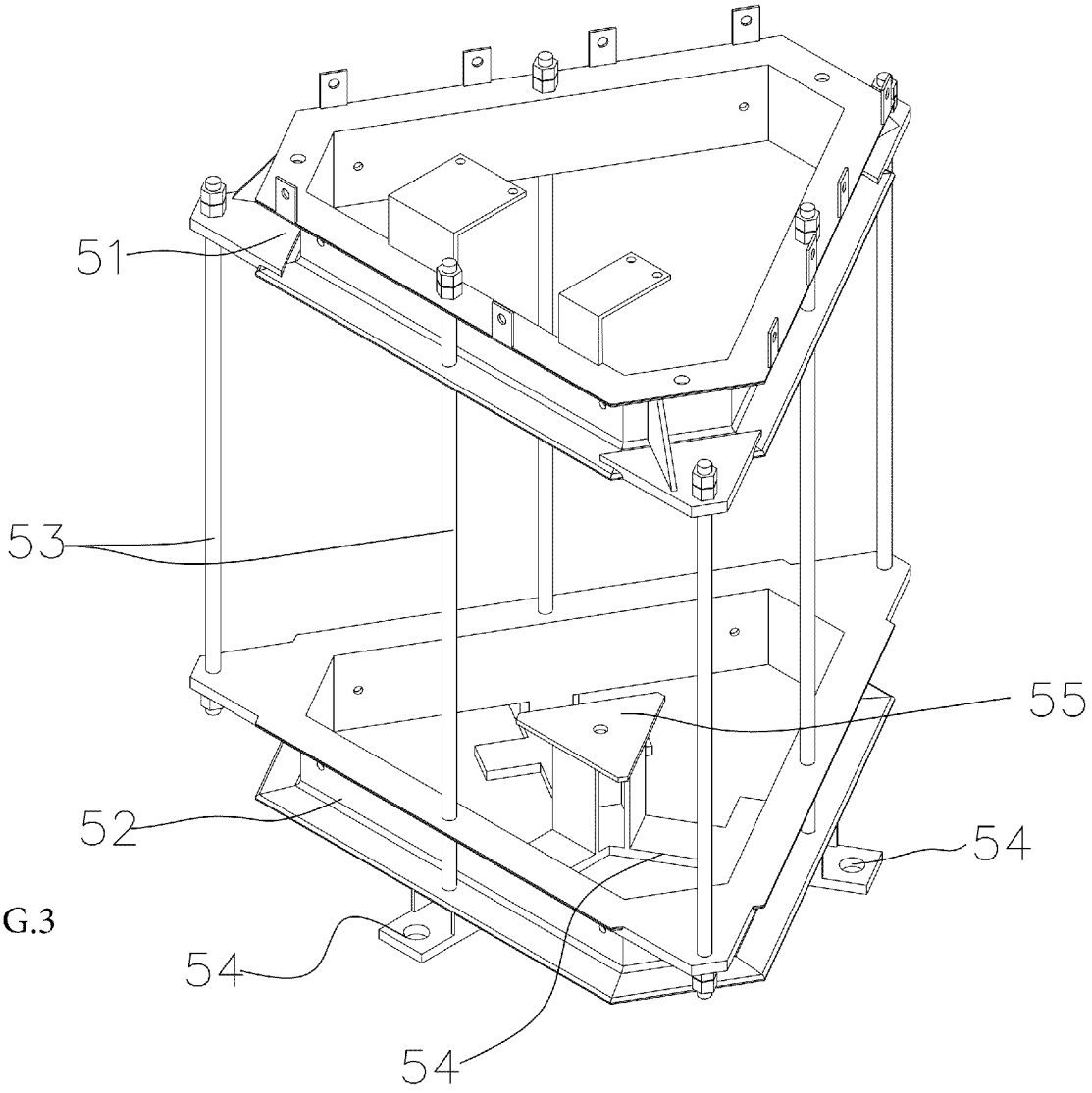
FIG. 3 is a perspective view of the clamp of the present invention.
Figure 4:
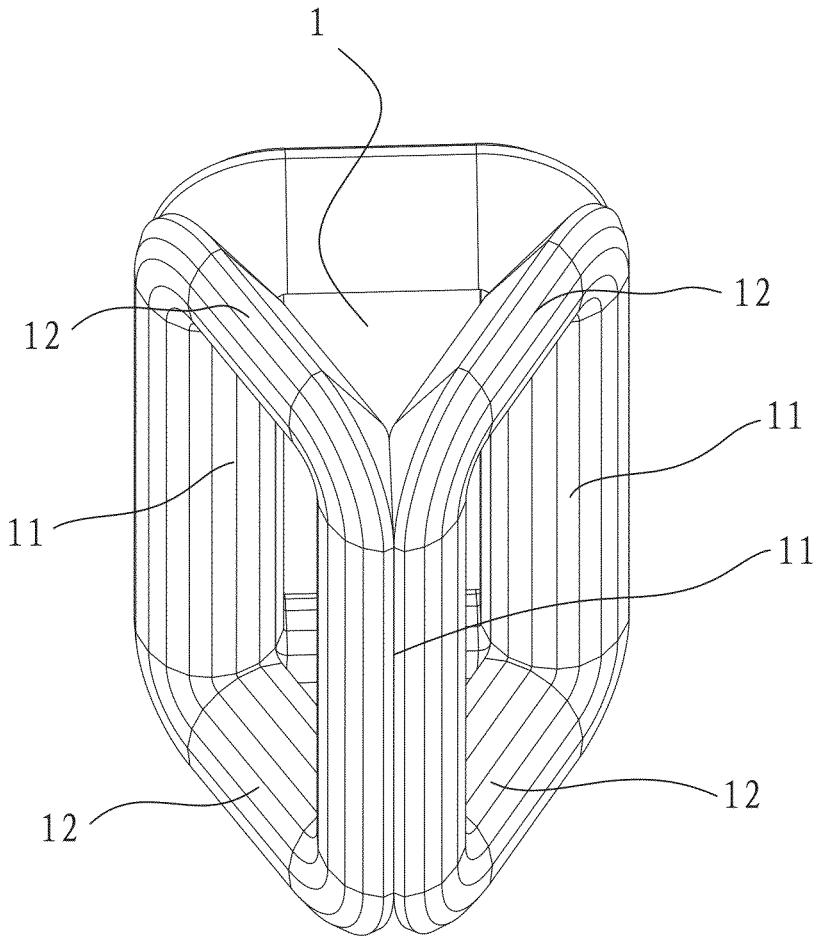
FIG. 4 is a perspective view of the iron core of the present invention.

As shown in FIGS. 1, 2 and 3, the oil immersed stereo wound-core amorphous alloy transformer provided by the present invention comprises an iron core 1, an high-low voltage winding 2, a plurality of leads 3 and a tank 4. As shown in FIG. 4, the iron core 1 has a triangular prism shape. The iron core 1 comprises three rectangular single frames which are made of amorphous alloy strips by winding and are identical in structure. The cross section of the sides of each single frame has a quasi-semi-circular or quasi-semi-polygonal shape. The single frames have semi-circular cross sections with uniform thicknesses. The vertical sides of two adjacent single frames fit together fixedly to form a core pillar 11. The horizontal sides of the single frames form iron yokes 12. Each core pillar 11 is approximately circular or polygonal in cross section.

As shown in FIG. 3, the transformer further comprises a clamp, comprising a quasi-triangle upper clamp 51, a quasi-triangle lower clamp 52, and posts 53. The lower clamp 52 is provided with three foot pads 54. One end of each foot pad 54 is for fixed connection to a base plate of the tank, and the other end is welded to a side of the lower clamp 52. The screws 53 are connected with the upper and lower clamps 51, 52. A lower center clamp 55 is provided in a central portion of the inner part of the lower clamp 52.

The iron yokes 12 in the lower portion of the iron core are located on the foot pads 54. The high-low voltage windings 2 are wound on the core pillars 11.

The clamp, the iron core 1, and the high-low voltage windings 2 wound on the core pillars 11 of the iron core 1 are arranged within the tank 4.

The foot pads 54 support the lower clamp 52 and are fixed to the base plate of the tank 4.

Figure 5:
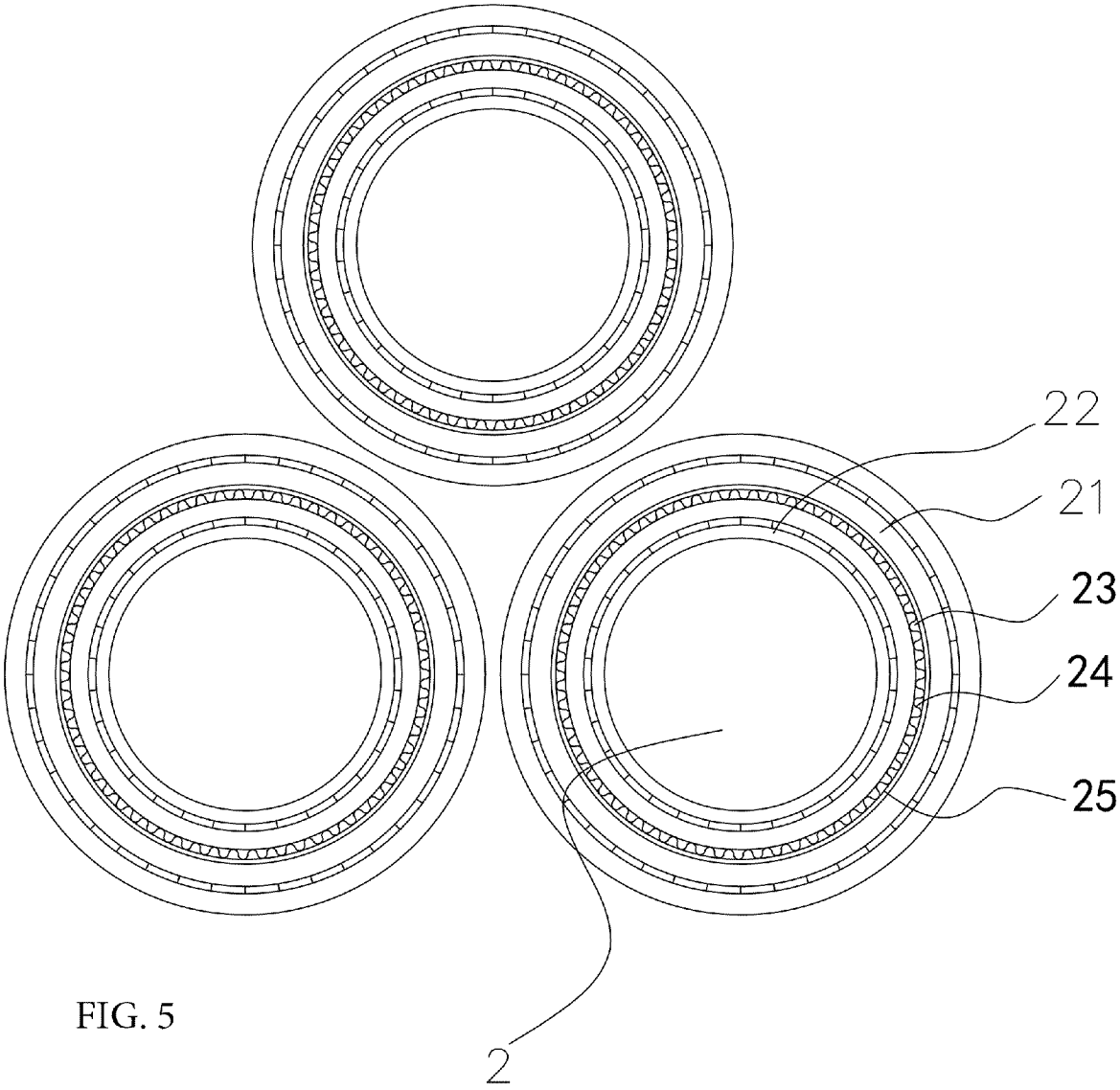
FIG. 5 is a cross sectional view of the high and low voltage windings of the present invention.

As shown in FIG. 5, oil ducts 23 are provided between the high voltage windings 21 and lower voltage windings 22 of the high-low voltage winding 2.

Optionally, insulating paper boards 25 and corrugated paper boards 24 are provided between the high voltage windings 21 and lower voltage windings 22.

For a two-winding transformer, the low voltage windings 22 are in the interior. After the low voltage windings are wound, the insulation paper boards 25 and corrugated paper boards 24 are placed for support and insulation between the high voltage windings 21 and low voltage windings 22, and then the high voltage windings 21 are wound thereon.

For monitoring and controlling the working temperature, oil ducts 23 are provided and radially arranged between the low voltage windings 22 and the high voltage windings 21.

The tank is quasi-triangle shaped in cross section.

Radiators 6 are provided on the side surfaces of the tank 4.

As the iron core 1 is configured in a symmetrically triangular shape in a horizontal plane, it is reasonable that the tank also has a triangular shape. According to the requirements for cooling, the radiators 6 are arranged on the three symmetrical side surfaces of the tank 6. This structure allows the transformer to be more compact and aesthetic, and to use less oil.

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims which are to be accorded with the broadest interpretation so as to encompass all such modifications and similar structure.

What is claimed is:

1. An oil immersed stereo wound-core amorphous alloy transformer, comprising:

an iron core, a high-low voltage winding including an inner low voltage winding and an outer high voltage winding, leads and a tank, the iron core comprises three single frames comprising a plurality of identical wound amorphous alloy strips, and the single frames have a rectangular shape;

the cross-section of the sides of each single frame has an approximately semi-circular or semi-polygonal shape;

the single frames have semi-circular cross sections and uniform thicknesses, vertical sides of every two adjacent frames fit together fixedly to form a core pillar, and horizontal sides of the single frame form iron yokes;

the cross section of the core pillars is in an approximately circular or polygonal shape;

the transformer further comprises a clamp, comprising a quasi-triangular upper clamp, a quasi-triangular lower clamp, a lower center clamp provided in a central portion of an inner part of the lower clamp, and a plurality of posts, the lower clamp is provided with three foot pads, each of the three foot pads respectively having a first end and second end, wherein each first end of each foot pad is for fixed connection, and each second end of each of the three food pads is welded to the lower center clamp;

the plurality of posts comprising a first plurality of posts that connect each vertex of the quasi-triangular upper clamp to a respective vertex of the quasi-triangular lower clamp and a second plurality of posts that connect each side of the quasi-triangular clamp to a respective side of the quasi-triangular lower clamp;

a plurality of cylindrical oil ducts radially provided between the high voltage winding and low voltage winding of the high-low voltage winding, the iron yokes in the lower portion of the iron core are located on the foot pads, and the high-low voltage winding is wound on the core pillars;

the clamp, iron core, and high-low voltage winding wound on the core pillars are arranged within the tank.

2. The oil immersed stereo wound-core amorphous alloy transformer according to claim 1, wherein the foot pads support the lower clamp and are fixedly connected to a base plate of the tank.

3. The oil immersed stereo wound-core amorphous alloy transformer according to claim 1, wherein the cross section of the tank is quasi-triangle shaped.

4. The oil immersed stereo wound-core amorphous alloy transformer according to claim 3, further comprising radiators on the side surfaces of the tank.

5. The oil immersed stereo wound-core amorphous alloy transformer according to claim 1 further comprising insulation paper boards and corrugated paper boards provided between the high voltage windings and the lower voltage windings of the high-low voltage winding.

* * * * *